US009814644B2

(12) United States Patent
Clark et al.

(10) Patent No.: US 9,814,644 B2
(45) Date of Patent: Nov. 14, 2017

(54) LIFTING DEVICE AND ASSOCIATED METHODS

(71) Applicant: REDLINE INNOVATIONS, INC., Rockledge, FL (US)

(72) Inventors: Robert Clark, Rockledge, FL (US); Michael Pannucci, Melbourne, FL (US)

(73) Assignee: Redline Innovations, Inc., Rockledge, FL (US)

( * ) Notice: Subject to any disclaimer, the term of this patent is extended or adjusted under 35 U.S.C. 154(b) by 0 days.

(21) Appl. No.: 14/718,458

(22) Filed: May 21, 2015

(65) Prior Publication Data

US 2016/0022522 A1 Jan. 28, 2016

Related U.S. Application Data

(60) Provisional application No. 62/002,035, filed on May 22, 2014.

(51) Int. Cl.
*A61G 5/00* (2006.01)
*A61G 7/10* (2006.01)

(52) U.S. Cl.
CPC ..... *A61G 7/1074* (2013.01); *A61G 7/1011* (2013.01); *A61G 7/1015* (2013.01); *A61G 7/1042* (2013.01); *A61G 7/1049* (2013.01); *A61G 7/1051* (2013.01); *A61G 7/1053* (2013.01); *A61G 7/1055* (2013.01); *A61G 7/1057* (2013.01)

(58) Field of Classification Search
CPC .. A61G 7/1074; A61G 7/1011; A61G 7/1015; A61G 7/1051; A61G 7/1049; A61G 7/1053; A61G 7/1055; A61G 7/1057; A61G 7/1038; A61G 7/1061; A61G 7/1042; A61G 7/1046; A61G 7/1044; A61G 7/1019
See application file for complete search history.

(56) References Cited

U.S. PATENT DOCUMENTS 508,866 A * 11/1893 Butcher ..... B66C 7/00 182/181.1
1,050,814 A * 1/1913 Demeree ..... A61G 7/1046 5/101
1,611,807 A * 12/1926 Bergh ..... A61H 3/04 297/6
1,738,758 A * 12/1929 Cottman ..... A61G 7/1015 5/51.1

(Continued)

*Primary Examiner* — David E Sosnowski
*Assistant Examiner* — Morgan McClure
(74) *Attorney, Agent, or Firm* — Mark Malek; Stephen Bullock; Widerman Malek, PL

(57) ABSTRACT

A lifting device may include a main body member and a top member that is detachably connectable to portions of the main body member. The top member may include a top and a hoist assembly that is connected to and extends outwardly from the top. The lifting device may be used to assist in lifting a patient from a seated or a prone position. The main body member is moveable between a collapsed position that is defined as side support member of the main body member being positioned adjacent to a support connecting member of the main body member, and the opened position is defined as a side support members of the main body member being positioned substantially perpendicular to the support connecting member.

17 Claims, 11 Drawing Sheets

(56) References Cited

U.S. PATENT DOCUMENTS 2,035,116 A * 3/1936 Elmick ..... A61G 7/1015 5/89.1
2,516,553 A * 7/1950 Cole ..... A61G 7/1015 280/79.2
2,595,651 A * 5/1952 Feist ..... A61G 7/053 212/343
2,666,930 A * 1/1954 Lenahan ..... A61G 7/053 5/86.1
2,793,800 A * 5/1957 Hudd ..... A47C 12/02 182/33
3,405,954 A * 10/1968 Wolfe ..... A61G 5/14 280/304.1
3,520,514 A * 7/1970 Evans ..... B66C 19/02 104/126
3,584,890 A * 6/1971 Presty ..... A61G 5/14 280/304.1
4,187,869 A * 2/1980 Marchetti ..... A61H 3/04 135/67
4,229,845 A * 10/1980 de Cuadros ..... A45F 3/24 5/114
4,296,509 A * 10/1981 Simmons ..... A61G 7/1015 248/168
5,117,516 A * 6/1992 Penner ..... A61G 7/1017 5/81.1 R
5,165,123 A * 11/1992 Colpron ..... A61G 5/10 254/326
5,380,262 A * 1/1995 Austin ..... A61H 3/04 280/647
5,381,873 A * 1/1995 Kniefel ..... E04H 3/126 182/152
5,412,820 A * 5/1995 Richards ..... A61G 7/1017 5/86.1
5,502,851 A * 4/1996 Costello ..... A61H 3/04 482/69
5,509,432 A * 4/1996 Peterson ..... A61G 7/1038 135/65
5,553,335 A * 9/1996 Lahtinen ..... A61G 7/1015 212/97
5,560,054 A * 10/1996 Simon ..... A61G 7/1017 5/83.1
5,603,677 A * 2/1997 Sollo ..... A61H 1/0229 135/67
5,694,654 A * 12/1997 Roy ..... A61G 7/1015 5/83.1
5,702,326 A * 12/1997 Renteria ..... A61H 3/04 135/67
5,708,993 A * 1/1998 Campbell ..... A61G 7/1019 177/144
5,802,633 A * 9/1998 Capaldi ..... A61G 7/1015 5/83.1
6,163,906 A * 12/2000 Kay ..... A61G 7/053 5/658
6,338,493 B1 * 1/2002 Wohlgemuth ..... A61G 5/00 135/66
6,533,135 B1 * 3/2003 Ford ..... A61G 7/1042 104/126
6,561,489 B1 * 5/2003 Wakefield ..... B62D 43/045 224/42.23
6,571,915 B1 * 6/2003 de la Tour ..... A47C 12/02 182/152
6,637,610 B1 * 10/2003 Cheeseboro ..... A61G 7/1015 212/324
6,821,233 B1 * 11/2004 Colombo ..... A61F 5/0102 482/54
6,890,288 B2 * 5/2005 Bingham ..... A47D 13/046 482/69
6,926,119 B1 * 8/2005 Schrock ..... E06C 1/393 182/106
7,097,157 B1 * 8/2006 Lodrick ..... B66D 3/18 211/105.4
7,108,004 B2 * 9/2006 Cowie ..... A45B 7/00 135/74
7,294,094 B1 * 11/2007 Howle ..... A61H 3/00 135/67
7,354,382 B1 * 4/2008 Warren, II ..... A61G 7/1017 482/68
7,373,942 B1 * 5/2008 Yeager ..... A61H 3/00 135/67
7,546,705 B1 * 6/2009 Rivera, Jr. ..... E04H 3/126 182/132
7,775,228 B2 * 8/2010 Clark ..... A61G 7/1038 135/66
7,921,484 B2 * 4/2011 Bendele ..... A61G 7/1015 5/81.1 R
8,151,812 B2 * 4/2012 Razon ..... A61H 3/04 135/66
8,286,281 B1 * 10/2012 Toothman ..... A61G 7/1015 248/166
8,397,320 B2 * 3/2013 Capaldi ..... A61G 7/1015 5/83.1
8,407,831 B2 * 4/2013 White ..... A61G 7/1017 212/901
8,584,273 B1 * 11/2013 Simoes ..... A61G 7/1019 5/81.1 R
8,745,791 B1 * 6/2014 Ullrich ..... A61G 1/017 5/625
8,915,383 B2 * 12/2014 Pedersen ..... A47G 7/041 211/149
9,089,461 B1 * 7/2015 Vosters ..... A47C 21/00
9,149,408 B2 * 10/2015 Karlovich ..... A63B 69/0064
9,161,871 B2 * 10/2015 Clement ..... A61G 7/10
9,351,898 B2 * 5/2016 Triolo ..... A61G 5/14
9,398,995 B2 * 7/2016 Tekulve ..... A63B 69/0064
2002/0069461 A1 * 6/2002 Egan ..... A61G 7/1017 5/81.1 R
2003/0188751 A1 * 10/2003 Rogozinski ..... A61G 7/1042 128/845
2006/0096626 A1 * 5/2006 Weaver ..... A61G 7/1038 135/67
2007/0246974 A1 * 10/2007 Bjork ..... A61G 7/1015 297/1
2008/0216232 A1 * 9/2008 White ..... A61G 7/1015 5/87.1
2009/0165203 A1 * 7/2009 Biersteker ..... A61G 5/14 5/83.1
2009/0188038 A1 * 7/2009 Raney ..... A61G 7/1017 5/87.1
2009/0249544 A1 * 10/2009 Palay ..... A61G 5/14 5/83.1
2011/0272913 A1 * 11/2011 Diamond ..... A61H 3/04 280/288.2
2012/0318311 A1 * 12/2012 Alghazi ..... A61G 5/085 135/66
2013/0062845 A1 * 3/2013 Huang ..... A61H 3/04 280/47.34
2013/0343862 A1 * 12/2013 Tindall ..... A61G 3/062 414/809
2015/0202110 A1 * 7/2015 Leier ..... A63B 21/00054 601/84
2015/0313784 A1 * 11/2015 Evans ..... A61H 1/0229 602/36

* cited by examiner

LIFTING DEVICE AND ASSOCIATED METHODS

RELATED APPLICATIONS

This application is related to and claims benefit under 35 U.S.C. §119(e) of U.S. Provisional Patent Application Ser. No. 62/002,035 titled Lifting Device and Associated Methods filed May 22, 2014, the content of which is incorporated by reference in its entirety to the extent disclosure therein is consistent with disclosure herein.

FIELD OF THE INVENTION

The present invention relates to the field of lifting devices and, more specifically to the field of lifting devices that are collapsible and can be used to assist in lifting patients, or other persons, and associated methods.

BACKGROUND OF THE INVENTION

Hospital staff and other medical personnel, such as paramedics, EMTs and firefighters, for example, often find themselves in a position where they must assist a patient from the ground. For example, in the case of first responders, there are often calls involving a patient that has fallen and cannot get up, or a patient that cannot rise unassisted from a seated or prone position. In such a case, the first responder often has to assist the patient by lifting the patient, which puts the first responder at risk for back injury.

Back injuries of first responders, or other medical professionals placed in the position of lifting patients that need assistance, have many ramifications. Of course, the biggest ramification may be to the injured medical professional. These types of injuries are often lingering, takes significant time to heal, prevents the injured medical professional from fully doing their job, and can sometimes cause permanent damage. These injuries can also take a financial to both the injured medical professional, as well as the organization that employs the medical professional, i.e., government entity, hospital, etc. For example, back injury to a medical professional brings on medical bills, missed work, paid time off to heal from the injury, worker's compensation claims, additional payroll to hire a substitute, disability costs, etc.

In the case of larger patients that may need assistance, often it may take more than one medical professional to perform a lift of that patient. In many scenarios, hospitals may be understaffed, and a task that needs more than one medical professional tasked medical staffing time away from other tasks, and may cause an already understaffed department to suffer further.

A device suitable for assisting medical personnel with necessary lifting activities is required to prevent injuries to medical personnel.

SUMMARY OF THE INVENTION

To address the above referenced issues, as well as several others, the lifting device according to embodiments of the present invention advantageously provides a lightweight solution that allows for ready deployment in many different situations. The lifting device according to embodiments of the present invention also advantageously provides a device that is collapsible and does not take up significant space where space may be at a premium, such as, for example, in a side compartment of an ambulance. The lifting device according to embodiments of the present invention further advantageously can be used by medical personnel to lift a patient while simultaneously reducing the risk of back injury.

These and other objects, features, and advantages according to the present invention are provided by a lifting device that includes a main body member and a top member. The main body member may include a support connecting member, and a pair of side support members that may each be hingedly connected to the support connecting members. Each of the support connecting members may include a pair of legs and a plurality of spaced apart brace members connected to the pair of legs. The top member may be detachably connectable to the pair or side support members, and may include a top, a pair of opposing channels adapted to matingly engage a portion of the side support members, and a hoist assembly connected to and extending downwardly from the top.

The main body member may be moveable between a collapsed position and an opened position. The collapsed position may be defined as the pair of side support members being positioned adjacent to the support connecting member, and the opened position may be defined as the side support members being positioned substantially perpendicular to the support connecting member. When in the opened position, the top member may be detachably connected to the pair of side support members.

DETAILED DESCRIPTION OF THE INVENTION

Figure 1:
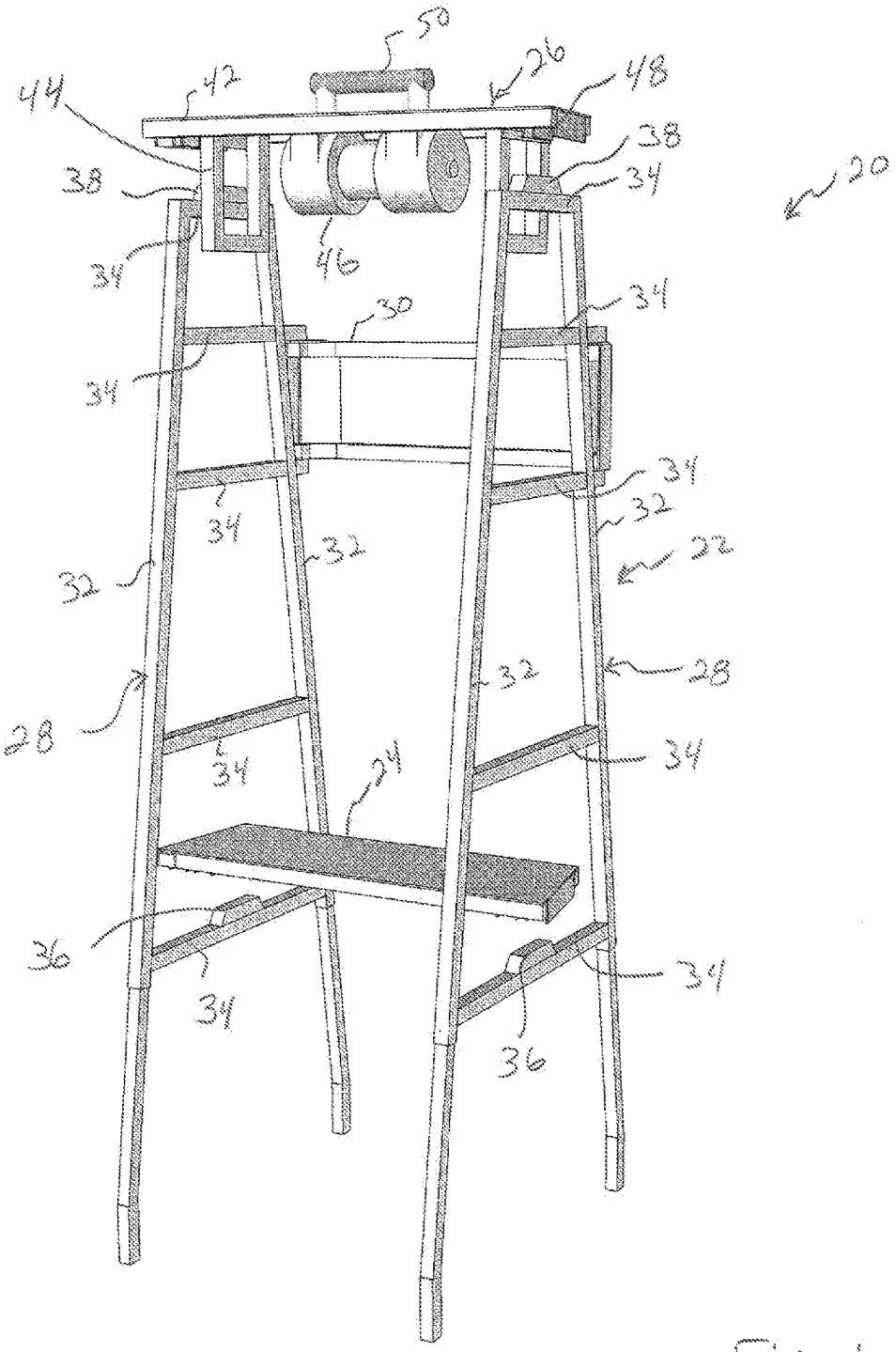
FIG. 1 is a perspective view of a lifting device according to the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

In this disclosure, many terms may be interchangeably used and should be understood by those skilled in the art not to be limiting in any way. For example, a "patient," a "user," or a "person" may be used to describe an individual that is being lifted using the lifting device according to embodiments of the present invention.

An embodiment of the invention, as shown and described by the various figures and accompanying text, provides a lifting device 20. The lifting device 20 according to embodiments of the present invention may advantageously be used to assist in lifting a person (or a patient) from the ground. For example, the lifting device 20 according to embodiments of the present invention may be used by ambulance personnel to lift a patient that may have fallen. Also for example, the lifting device 20 may be used by hospital personnel to lift patients, or to assist patients that are not otherwise mobile, who may need to be moved from one position to another, e.g. from a wheel chair to a bed. Those skilled in the art will appreciate that the lifting device 20 according to embodiments of the present invention may advantageously be used for any number of necessary lifting necessities in any number of different situations.

The lifting device 20 according to the present invention may be used to prevent back injury, for example, of personnel that may be responsible for lifting patients, or other persons. For example, and in reference to ambulance personnel, it is well known that there are several calls to assist fallen patients. Back injuries may occur to ambulance personnel when attempting to lift such patients, especially when the patient is located on the ground. Using the lifting device 20 according to embodiments of the present invention may advantageously reduce, or even eliminate, such back injuries that ambulance personnel may sometimes suffer. A similar situation occurs when hospital personnel have to help patients from the ground, or even when assisting a patient in moving from one position to another. The lifting device 20 according to the present invention may be used to eliminate such potential injuries.

Further, use of the lifting device 20 according to the present invention may greatly reduce the risk of injury to a patient. The process for lifting a patient that may be positioned on the ground, or move the patient from one location to another, can sometimes be dangerous for the patient. The lifting device 20 according to embodiments of the present invention may advantageously be used to readily move the patient as necessary, while simultaneously reducing the risk of injury to the patient.

Figure 2:
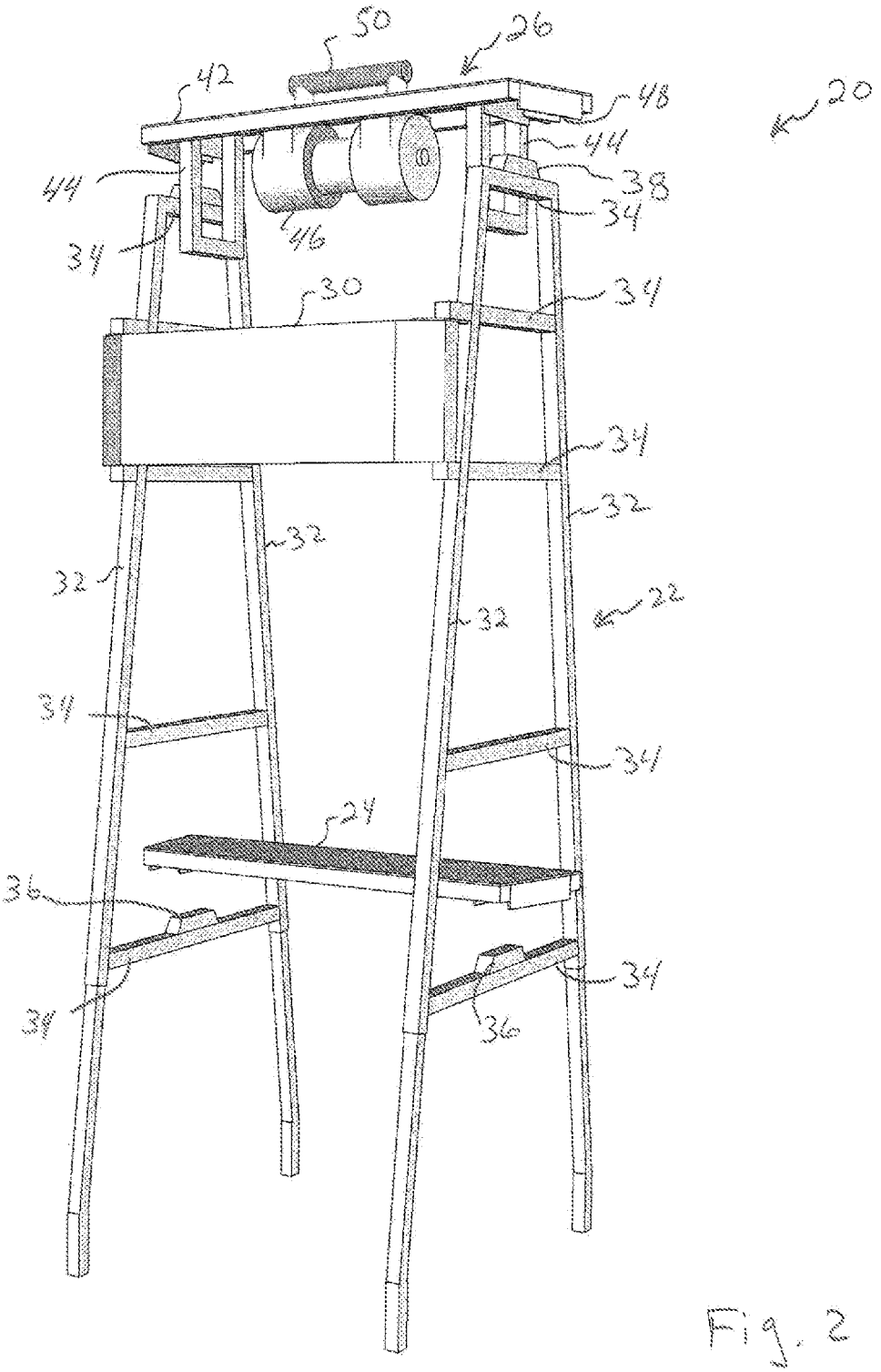
FIG. 2 is another perspective view of the lifting device illustrated in FIG. 1.

Referring now more specifically to FIGS. 1 and 2, additional features of the lifting device 20 are now described in greater detail. More specifically, the lifting device 20 may illustratively include a main body member 22. The main body member 22 may be collapsible so as to minimize space necessary for storage, and to allow a user to be able to readily transport the lifting device 20. The main body member 22 of the lifting device 20 according to embodiments of the present invention is shown in the collapsed position in FIGS. 5-6 and 8-9. Additional details of the collapsibility of the main body member 22 of the lifting device 20 according to embodiments of the present invention will be discussed in greater detail below.

Figure 3:
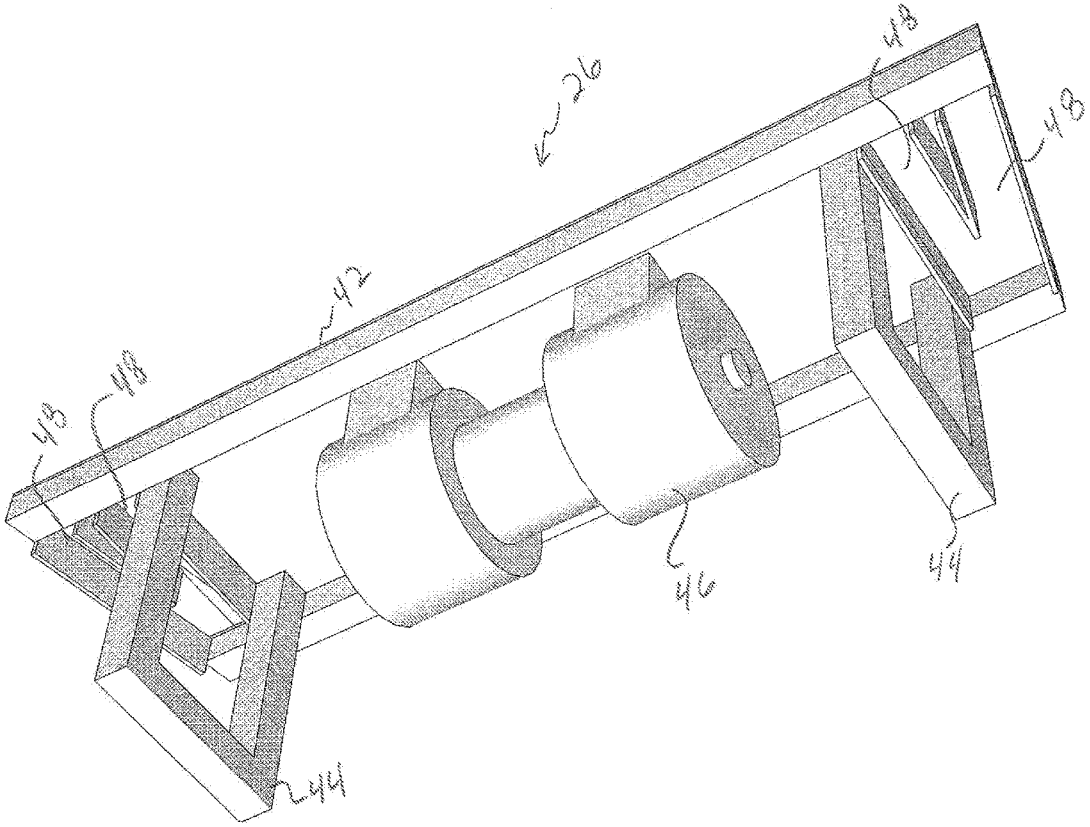
FIG. 3 is a perspective view of a top member of the lighting device illustrated in FIG. 1 and including a hoist.
Figure 4:
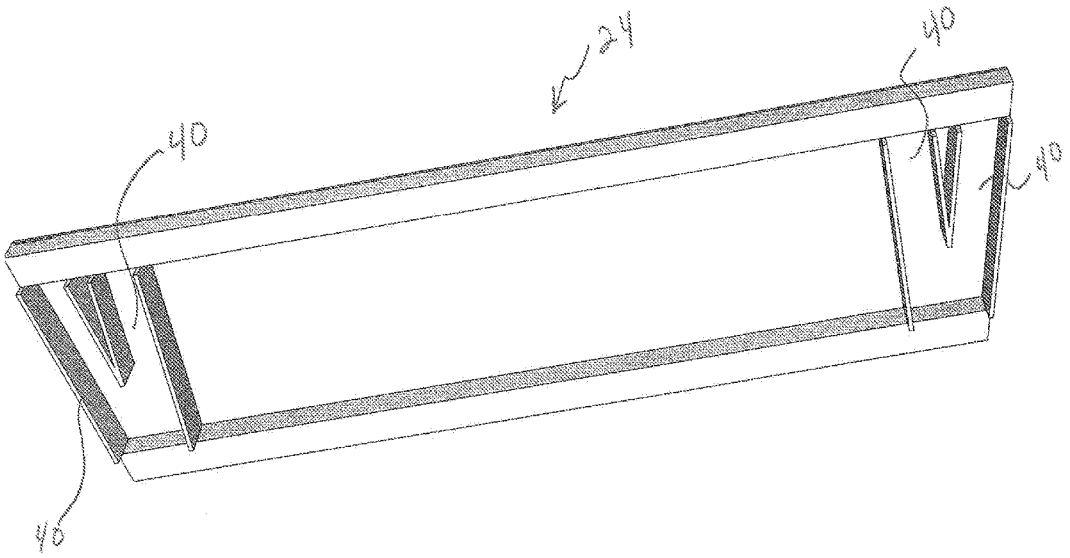
FIG. 4 is a perspective view of a seat member of the lifting device illustrated in FIG. 1.
Figure 5:
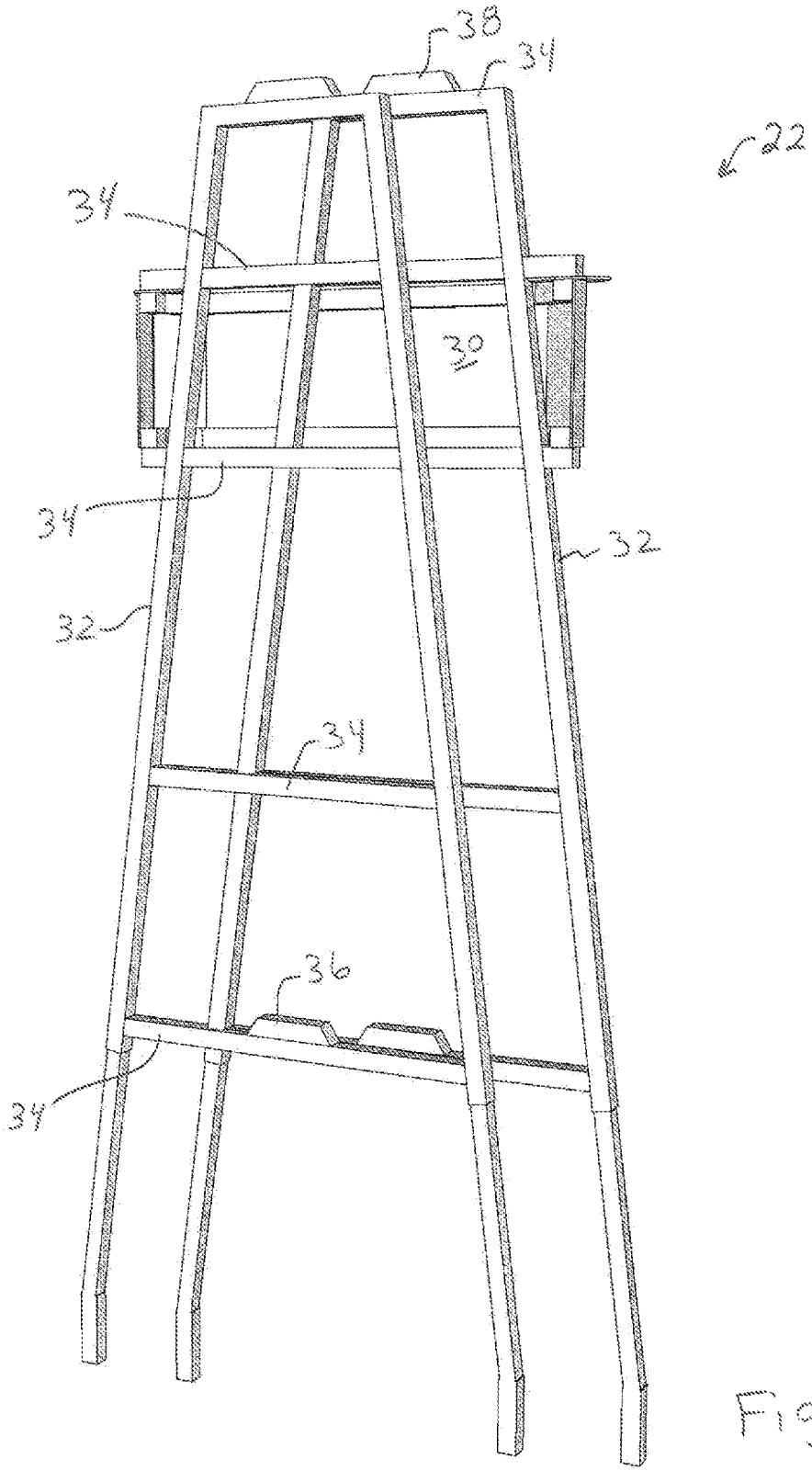
FIG. 5 is a perspective view of the lifting device illustrated in FIG. 1 shown in a collapsed position.
Figure 6:
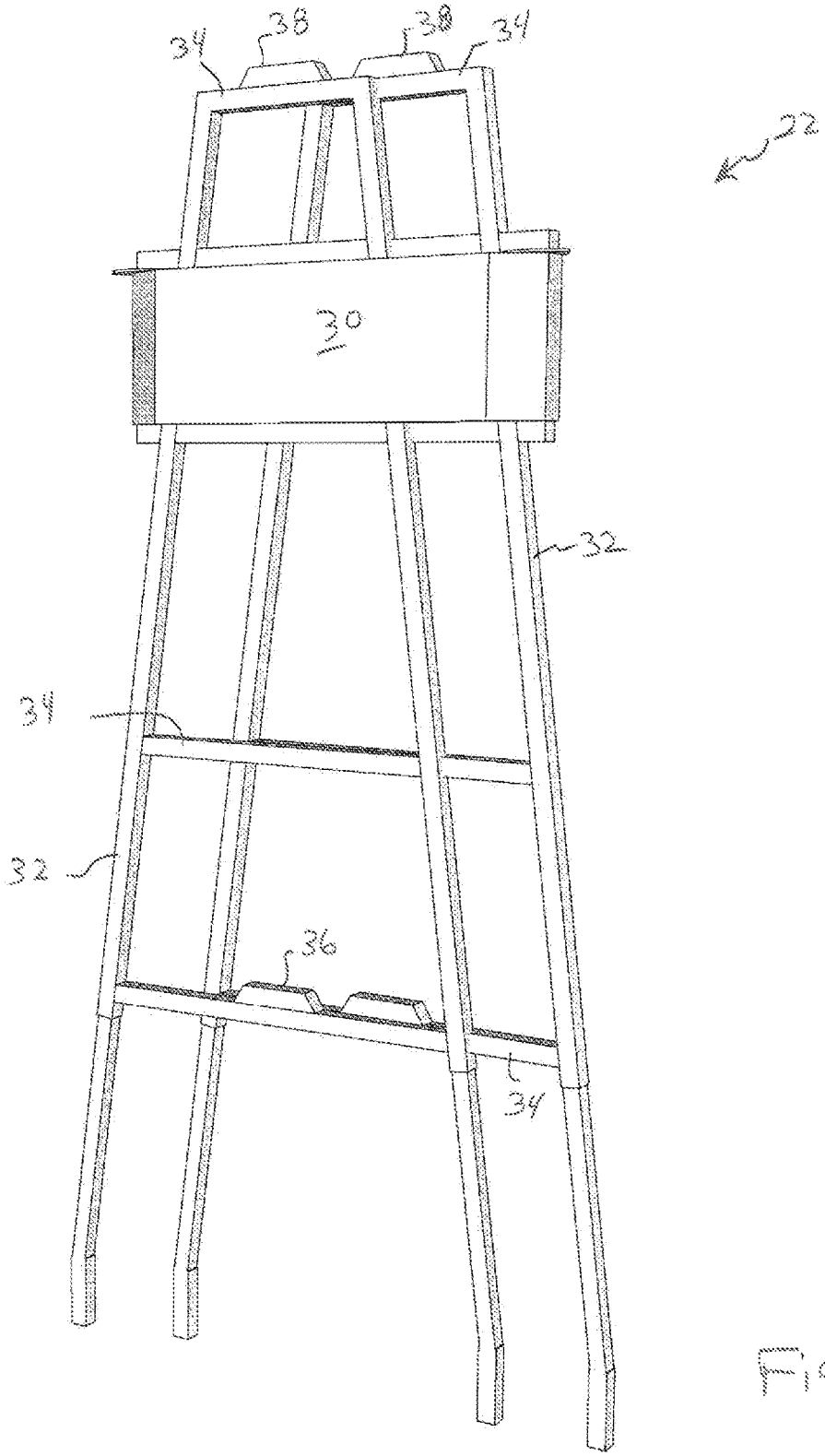
FIG. 6 is another perspective view of the lifting device illustrated in FIG. 1 also shown in the collapsed position.

The lifting device 20 may also illustratively include a seat member 24 that is adapted to matingly engage a portion of the main body member 22 when the main body member is in an opened position. The seat member 24 is also illustrated in FIG. 4, and will be discussed in greater detail below. The lifting device 20 may further include a top member 26 that is also adapted to be connected to the main body member 22 when the main body member is in the opened position. The top member 26 is illustrated in FIG. 3, and will be discussed in greater detail below.

As briefly noted above, the main body member 22 of the lifting device 20 may be moved between a collapsed position and an open position. The lifting device 20 is illustrated in the open position and FIGS. 1-2. Further, and with reference to FIGS. 5-6 and 8-9, the lifting device 20 may be collapsed to the collapsed position so as to allow for a user to readily transport the lifting device, and to allow for easy storage of the lifting device. The lifting device may include a pair of side support members 28. The side support members 28 may be connected to one another by a support connecting member 30. More specifically, the side support members 28 may be hingedly connected to the support connecting member 30 so as to allow for each of the side support members 28 to be rotatably connected to the support connecting member. Each of the side support members 28 may include a pair of legs 32. The pair of legs 32 are preferably connected to one another using a plurality of spaced apart brace members 34. In the illustrated embodiment, an upper portion of each of the pairs of legs 32 is connected to one another by an uppermost brace member 34. As the legs 32 extend downwardly from the uppermost brace member 34, the distance between each of the legs preferably increases. This advantageously provides enhanced stability to the lifting device 20 when configured in the opened position.

The illustrated embodiment of the lifting device 20 shows five brace members 34 extending between each of the pair of legs 32 of the side support members 28. Those skilled in the art, however, will appreciate that any number of brace members 34 may be provided while still accomplishing the goals, features, and objectives according to embodiments of the present invention. Further, those skilled in the art will appreciate that although the legs 32 of the side support members 28 of the lifting device 20 according to the present invention are illustrated as having an greater distance between a bottom portion of the legs than the distance between a top portion of the legs, the distance between the legs can be uniform throughout the entire distance of the side support members 28 while still accomplishing the goals, features and objectives according to embodiments of the present invention.

As perhaps best illustrated in FIG. 1, the legs 32 of each of the side support members 28 are extendable. This advantageously allows for the height of the lifting device 20 to be variable depending on the type of situation where the lifting device is to be used. More specifically, a bottom portion of each of the legs 32 of the side support members 28 may slidably engage the bottom portion of the side support members. In some embodiments, the legs may engage a hollow tube so as to allow for the bottom portion of the legs to extend inwardly and outwardly therefrom to allow for the height of the lifting device 20 according to the present invention to be adjusted. A lock mechanism may be provided so as to allow for the legs 32 of the side support members 28 to be locked in place when the desired height is achieved. The lock mechanism may, for example, be provided by a pushbutton lock that engages a plurality of passageways formed in the two through which each of the legs is to engage. Alternatively, each of the legs may have passageways formed therethrough, and the tube portion of the bottom of the side support members 28 may have corresponding passageways formed therethrough. Alignment of passageways may allow for a locking member, such as a pin, for example, to be passed through each of the passageways to lock the legs 32 in place with respect to the side support members 28 to thereby prevent longitudinal movement. Other lock mechanisms may also be provided, as may be understood by those skilled in the art, while still accomplishing the goals, features and advantages according to embodiments of the present invention.

The support connecting member 30 of the main body member 22 is preferably connected between a pair of the brace members 34 that are generally positioned toward an upper portion of the main body member 22. More specifically, the brace members 34 that are connected to the support connecting member 30 preferably has a length that extends beyond one of the legs 32 of the side support members 28. The overlap of the brace members 34 allow the support connecting member 30 to be connected thereto. The connection between the support connecting member 30 and the brace members 34 may be provided by a nut and bolt type of connection that allows for the side support members 28 to be pivotally (or rotatably or hingedly) connected to the support connecting member 30. More specifically, the connection between the support connecting member 30 and each of the side support members 28 advantageously allows the main body member 22 to be moved between the collapsed position and the opened position. When in the opened position (illustrated in FIGS. 1-2), the side support members 28 are preferably positioned close to perpendicular to the support connecting member 30. When in the collapsed position (illustrated in FIGS. 5-6), the side support members 28 are positioned adjacent to the support connecting member 30 so as to extend substantially parallel therewith. Those skilled in the art will appreciate that the opened position of the main body member 22 does not necessarily require that each of the side support members 28 are perpendicular with the support connecting member 30. More specifically, it is to be understood by those skilled in the art that the side support members 28 may extend at any angle with respect to the support connecting member 30 that is suitable to provide stability to the lifting device 20 when the main body member 22 is in the opened position.

When in the open position, the seat member 24 may be connected to the side support members 28. More particularly, the seat member 24 may be carried by a pair of opposing brace members 34 of the side support members 28 of the main body member 22. As illustrated, a seat connecting member 36 may be connected to and extend upwardly from the brace member 34 that is intended to be used to carry the seat member 24. The seat connecting member 36 may, for example, be a raised section that is connected to the brace member 34 along a medial portion thereof. The connection between the seat connecting member 36 and the brace member 34 may, for example, be a welded connection. Those skilled in the art will appreciate, however, that the brace member 34 and the seat connecting member 36 may also be integrally molded as a monolithic unit.

Referring now to FIG. 4, additional details of the seat member 24 are now described in greater detail. A bottom portion of the seat member 24 is illustrated in FIG. 4. The seat member 24 may have a recessed bottom, and a plurality of opposing channels 40 formed therein. The channels 40 formed in the bottom portion of the seat member 24 are adapted to engage the seat connecting members 36 on the brace member 34 of each of the side support members 28. This advantageously allows for the seat member 24 to be locked in place when connected to the brace members 34 of the side support members 28. Accordingly, the channels 40 are sized to receive the seat connecting members 36. In other words, the width of each of the channels 40 is preferably slightly wider than the width of the seat connecting members 36 so that the seat connecting members may matingly connect to portions of the seat member. Those skilled in the art will appreciate that the width of the channel 40 is preferably sized so as to readily receive the seat connecting members 36 so that the connection between the seat connecting members 36 and each of the channels 40 is preferably tight to prevent movement of the seat when positioned to engage the brace members.

Continuing to refer to FIG. 4, the seat member 24 may have a polygonal shape, but those skilled in the art will appreciate that the seat member may have any shape while carrying out the goals, features and objectives according to embodiments of the present invention. In the illustrated embodiment, however, the seat member 24 includes a top portion, sidewalls extending downwardly from the top portion, and a bottom. The bottom portion of the seat member 24 is illustratively recessed, and the channels 40 may be defined by the channel walls positioned between the sidewalls of the seat member. More specifically, some of the sidewalls that extend downwardly from the top may be used to define the channels 40. Further, different orientations of the channels 40 are provided. This advantageously allows the side support members 28 to be pivoted in a number of different configurations and allow for the seat member 24 to be connected to the seat connecting members 36 accordingly. In other words, the differing configurations of the channels 40 formed on the bottom portion of the seat member 24 allows for the side support members 28 of the main body member 22 of the lifting device 20 to be used in differing configurations which advantageously allows for the lifting device to be used with different patients and in different situations.

For example, a patient that may be heavier and that may require a wider seating area may need for the legs 32 of the side support members 28 to be separated somewhat further apart. The adaptability of the seat member 24 and, more particularly, the different configurations of the channels 40 of the seat member advantageously allows for such an accommodation. Similarly, there may be a situation where the lifting device 20 according to the present invention needs to be used in a narrow area, such as, for example, a stairwell. The configuration of the channels 40 on the seat member 24 may allow for a narrower configuration of the legs 32 of the side support members 28. The ability of the lifting device 20 according to the present invention to have an adjustable height may also advantageously provide the ability to use the lifting device on uneven or un-level surfaces. For example, if using the lifting device 20 on a stair well, it is contemplated that one set of legs, i.e., the front legs, may be adjusted to have a different length than the other set of legs, i.e., the rear legs. Although it is not preferable to use the lifting device 20 according to the present invention on such a surface, the adjustability of the legs of the lifting device allows for such capabilities.

Referring now back to FIG. 3, the top member 26 of the lifting device 20 according to embodiments of the present invention is now described in greater detail. The top member 26 may include a top 42 that may have a substantially polygonal shape. As with the seat member 24, the top 42 may have any shape while still accomplishing the goals, features and objectives according to embodiments of the present invention. The top 42 may have sidewalls that extend downwardly therefrom. Similar to the seat member 24, the bottom portion of the top may have a recess formed therein. Further, a plurality of channels 48 may be formed in the bottom portion of the top member 26. The channels 48 of the top member 26 may have a similar configuration to the channels 40 of the seat member 24. In other words, the configurations of the channels 48 of the top member 26 may vary to accommodate different positions of the side support members 28 of the main body member 22. Accordingly, it is preferable that the channels 48 of the top member 26 have configurations that are aligned with the channels 40 of the seat member 24. More specifically, the channels 48 are adapted to engage a pair of top connecting members 38 that are connected to and extend upwardly from the uppermost brace member 34 on each of the side support member 28.

The top member 26 may also include a plurality of legs 44 that extend downwardly from the top 42. The plurality of legs 44 may, for example, be a pair of opposing legs. The respective opposing legs 44 are preferably positioned adjacent to the channels 48. As also illustrated in FIG. 3, the top member 26 may include a hoist assembly 46 connected to a bottom portion of the top 42. The hoist assembly 46 may be used in the lifting operation of the lifting device. In other words, the hoist assembly 46 may be used to lift a patient, which is perhaps best illustrated in FIG. 7. Details of operation of the lifting device 20 according to embodiments of the present invention will be provided in more detail below. The hoist assembly 46 may, for example, be provided by a winch that may be electrically operated. Those skilled in the art will appreciate that the hoist assembly 46 may also have a backup manual operation capability that allows for manual operation thereof. This advantageously eliminates the need for power so that the lifting device 20 according to the present invention may be used in situations where power might not be available.

A handle 50 may be connected to the top 42 of the top member 26. The handle 50 may advantageously be used when transporting the lifting device 20. More specifically, and with reference to FIGS. 8 and 9, the top member 26 may be connected to the seat member 24 so that the top member 26 and the seat member 24 may be readily transported as a single unit where the hoist assembly 46 is positioned between the top member 26 and the seat member 24. The legs 44 of the top member 26 may be positioned to engage one of the channels 40 of the seat member 24. Accordingly, when the legs 44 of the top member 26 engage the channels 40 of the seat member 24, the combined top member and seat member may be carried by a user that engages the handle 50 on the top member 26. It is preferable that the legs 44 of the top member 26 are angled so as to be suitable to engage the innermost channels 40 of the seat member 24. Those skilled in the art will appreciate that the legs 44 of top member 26 may be configured to engage the innermost sidewalls of the channels 40 of the seat member 24. In other words, the legs 44 of the top member 26 may be configured so as not to engage the channels 40 of the seat member 24, but instead to engage a wall of the channel, e.g., outside the channel, but still in contact with the wall of the channel. This embodiment is illustrated best in FIG. 10. The skilled artisan will also appreciate that the legs 44 of the top member 26 may be configured in any way to engage anyone of the channels 40 of the seat member 24, or none of the channels, provided that the legs of the top member may engage some portion of the seat member so that the seat member and the top member may be transported together.

Figure 10:
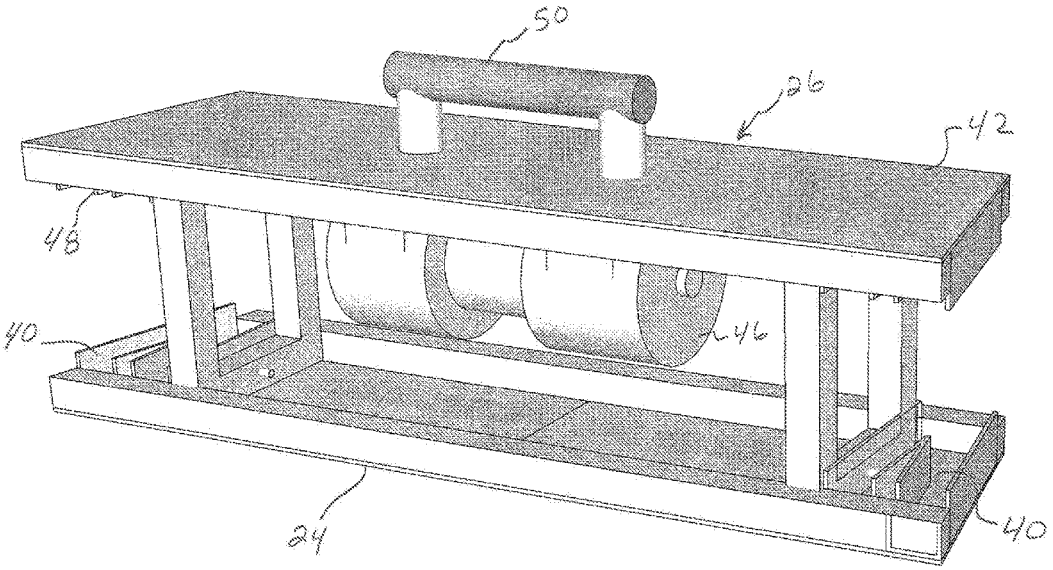
FIG. 10 is a perspective view of the top member of the lifting device illustrated in FIG. 1 being connected to the seat member of the lifting device and adapted to be transported.

Referring now to FIG. 10, an alternate view of the combination of the seat member 24 and the top member 26 are described in greater detail. In the embodiment of the combination of the seat member 24 and the top member 26 illustrated in FIG. 10, the legs 44 of the top member 26 are connected to the innermost sidewall that forms the channels 40 of the seat member 24. This connection may be provided by any number of connections such as, for example, a passageway and pin lock configuration, or any other type of configuration suitable for connecting the legs 44 of the top member to some portion of the seat member 24.

Figure 11:
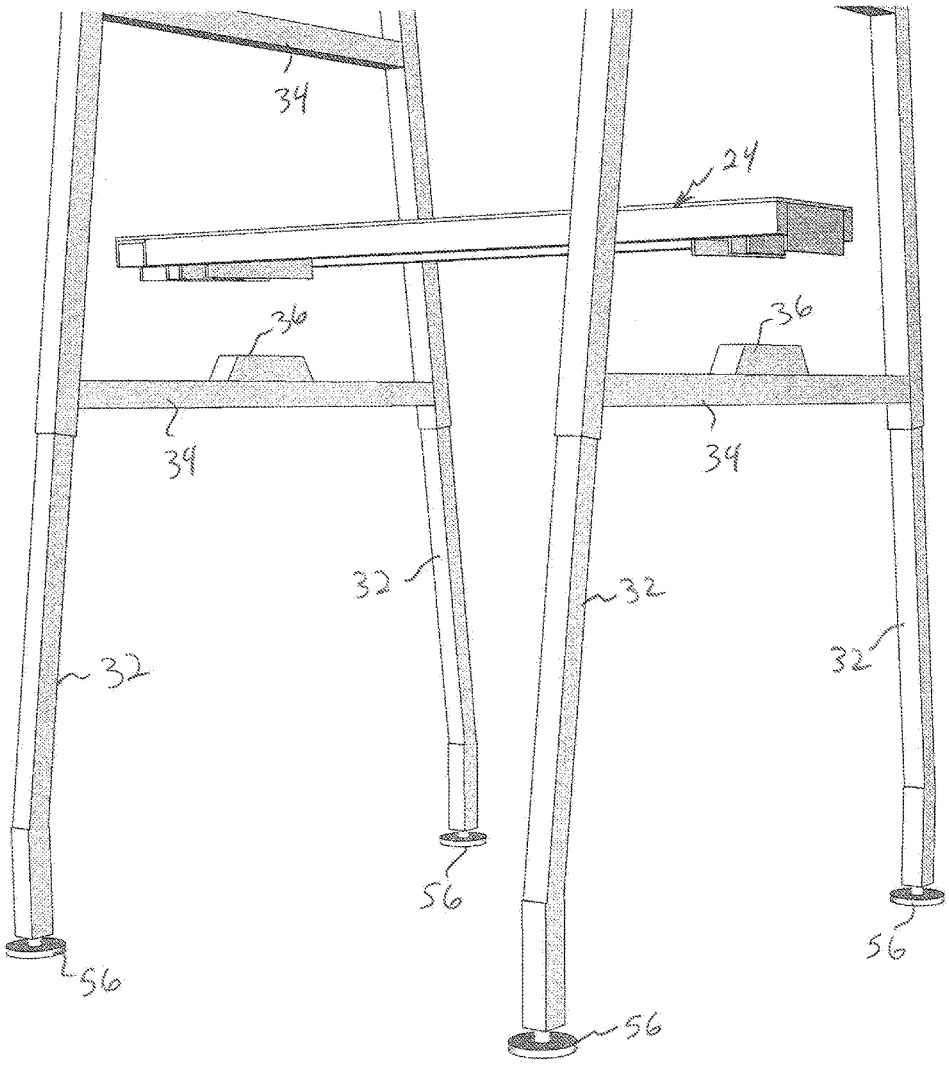
FIG. 11 is a perspective view of a portion of the main body member of the lifting device according to the present invention and showing foot members connected to a bottom portion of each of the legs.

Referring now to FIG. 11, another feature of the lifting device 20 according to an embodiment of the present invention is now described in greater detail. More specifically, the main body member 22 of the lifting device 20 of an embodiment of the present invention may include foot members 56 that are adapted to be connected to the bottom portion of the legs 32 of the side support members 28. As illustrated, the foot members 56 may, for example, be flat in shape. This advantageously provides enhanced stability to the lifting device. In other words, the foot members 56 having a flat configuration may provide a more stable surface to support the lifting device 20. Those skilled in the art will appreciate that the foot members 56 may be pivotal with respect to the bottom portion of each of the legs 32 of the side support members 28. Further, those skilled in the art will appreciate that the foot members 56 may be inserted into a bottom portion of each of the legs 32. Alternatively, the foot members 56 may be threadably connected to the legs 32. Those skilled in the art will appreciate that there are many configurations for connecting the foot members 56 to the legs 32, and each configuration that is suitable for connecting the foot members to the legs is contemplated and intended to be included within this disclosure.

In an alternate embodiment, the foot members 56 may be provided by casters, or other wheeled devices. Using casters advantageously allows the lifting device 20 to be readily moved after the patient has been lifted. For example, it may be desirous to lift a patient from one location and move the patient to another area by simply moving the lifting device 20 that has casters as the foot members 56. This advantageously provides enhanced operation of the lifting device and allows for the lifting device 20 to be used to readily move patients while simultaneously reducing the risk of injury to persons that may be necessary to lift the patient.

Figure 7:
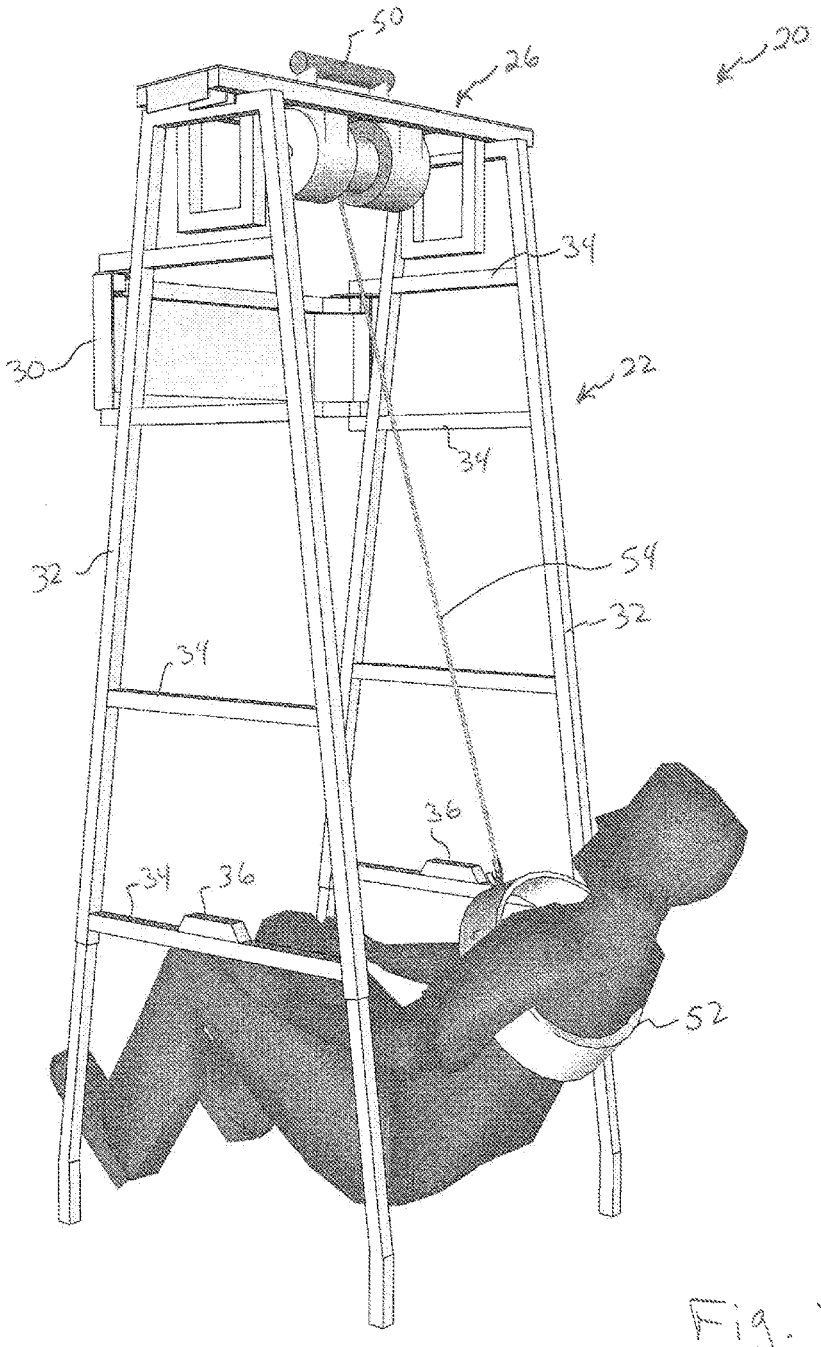
FIG. 7 is an environmental view of the lifting device illustrated in FIG. 1 being used to lift a patient.
Figure 8:
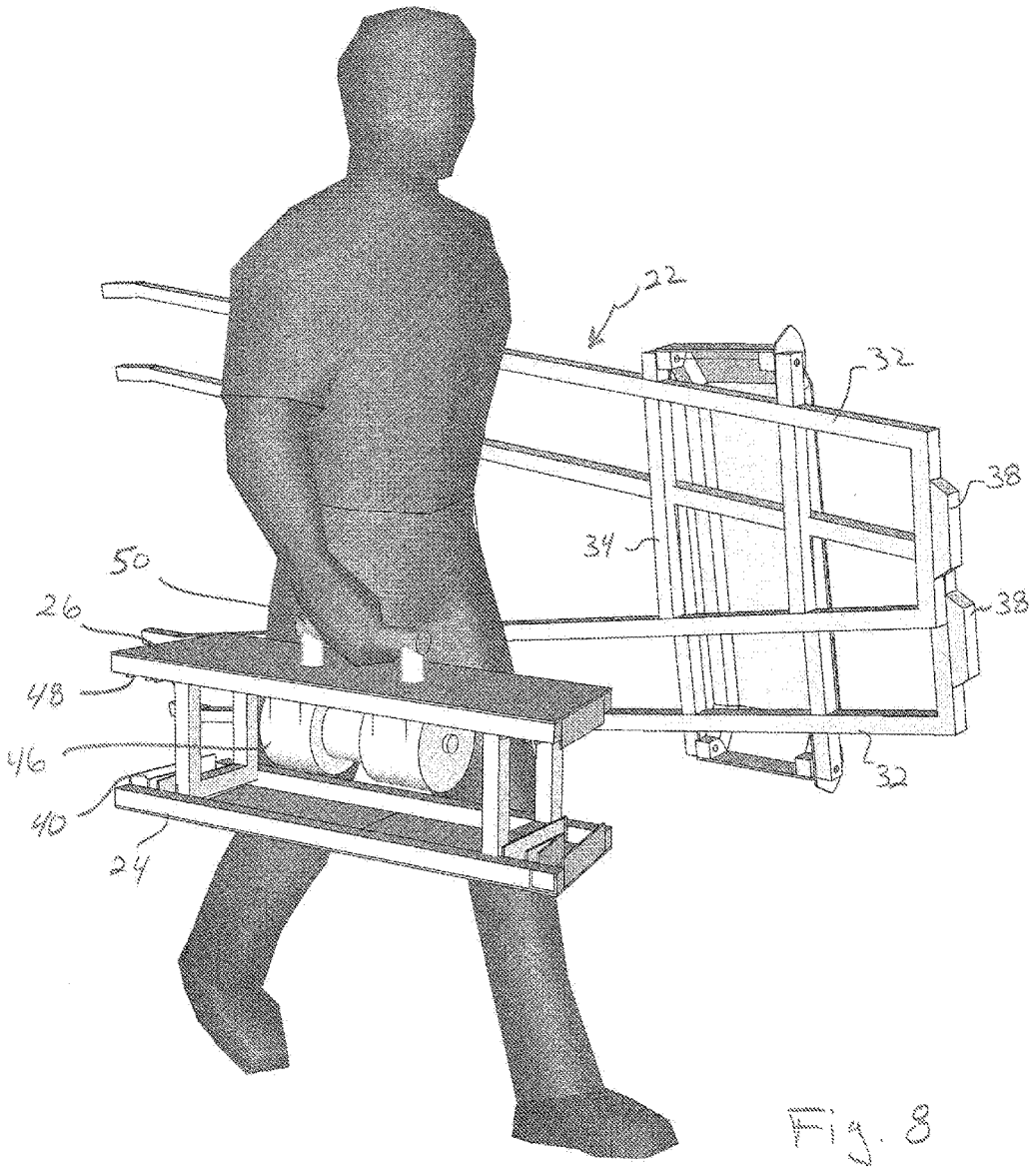
FIG. 8 is an environmental view of components of the lifting device illustrated in FIG. 1 shown being carried by a user.
Figure 9:
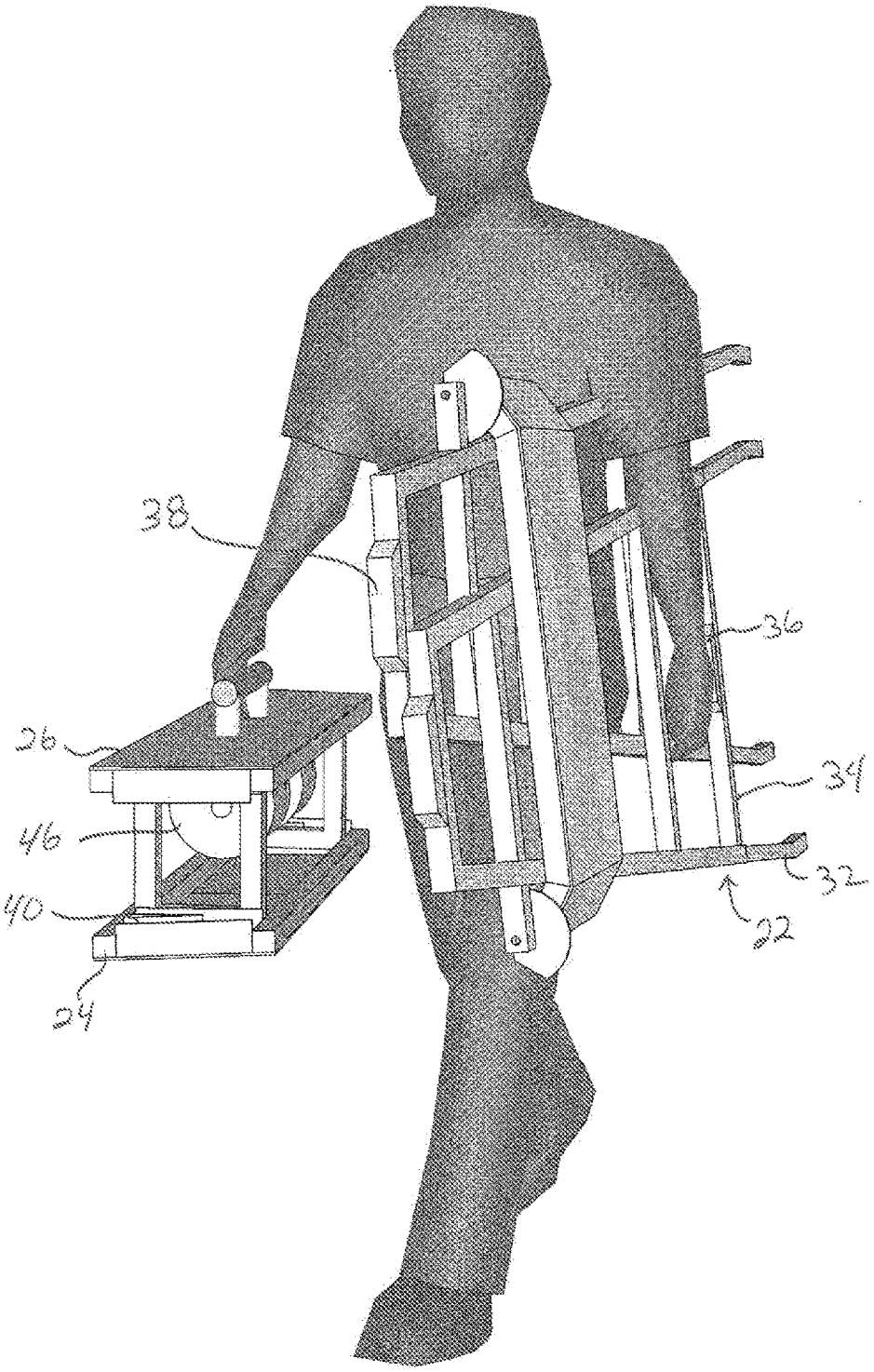
FIG. 9 is another environmental view of components of the lifting device illustrated in FIG. 1 shown being carried by a user.

Referring now back to FIG. 7, operation of the lifting device 20 according to the present invention is now described in greater detail. If, for example, a patient is on the floor (or ground) and needs to be lifted therefrom, the lifting device 20 according to the present invention may be used to achieve such a task. More specifically, an engagement strap 52 may be positioned around the patient, or the person that needs to be lifted from the ground. Upon connecting the engagement strap 52 to the patient, the engagement strap may be connected to the hoist assembly 46. More particularly, the hoist assembly 46 may include a line 54 that may connect to a portion of the hoist assembly and a portion of the engagement strap 52 so that the patient may be lifted when the hoist assembly is engaged. The engagement strap 52 may, for example, be provided by a belt, or any other type of device suitable for being positioned around a patient to assist in lifting the patient using the lifting device 20 according to the present invention. More specifically, it is preferable that the engagement strap 52 be positioned under the patient's arms so that the patient may be comfortably lifted. Those skilled in the art, however, will appreciate that there are many other ways to lift the patient.

The lifting device 20 according to the present invention is advantageously configured for fast setup. In many cases, the lifting device 20 may include a carrying case (not shown) so that the lifting device may be positioned therein. The carrying case may, for example, be used to protect the lifting device. Those skilled in the art will appreciate, however, that the carrying case is merely an accessory item, and not required for operation of the lifting device 20 according to embodiments of the present invention. The lifting device 20 is adapted to be sized so as to be able to be positioned in a storage bay of an ambulance, for example. As illustrated, for example, in FIGS. 5 and 6, when in the collapsed position, the main body member 22 of the lifting device 20 according to the present invention is substantially flat. Accordingly, when being stored, the lifting device does not use excess space. Therefore, a storage bay of an ambulance where backboards are typically stored may be suitable for carrying the main body member 22 of the lifting device 20. Accordingly, use of the lifting device 20 does not necessitate reconfiguration of standard ambulances. Instead, the lifting device 20 of the present invention may advantageously be used on existing ambulances.

Upon, removing the lifting device 20 from storage, the side support members 28 may be pivoted outwardly, i.e., the main body member 22 may be moved from the closed position to the opened position. Upon moving the main body member 22 from the closed position to the opened position, the top member 26 may be positioned on the upper portion of the main body member 22 so that the top member engages upper portions of the side support members 28.

As illustrated in FIG. 7, use of the seat member 24 is optional. The seat member 24 would not be used in cases where the patient is being lifted from the ground. Upon lifting the patient from the ground using the lifting device 20, however, it is contemplated that the seat member 24 may be installed so that the patient may be lowered onto the seat member 24. Installation of the seat member 24 may be readily achieved by positioning the channels 40 of the seat member 24 to engage the seat engagement members 36 carried by the brace members 34. Upon positioning the patient onto the seat member 24, the patient may be disconnected from the engagement strap 52. With the patient on the seat member 24, the patient may be at an elevation suitable for moving the patient to any number of other devices, i.e., a wheelchair, a stretcher, a seat, a bed, etc.

After the patient has been successfully lifted using the lifting device 20 according to the present invention, the lifting device may be readily broken down (or collapsed) and transported back to its storage area. As illustrated, for example, in FIGS. 8 and 9, when the lifting device 20 is in the collapsed position, it may be readily transported by one person. For example, a user may transport the collapsed lifting device 20 by positioning it under one arm and grasping the legs 32 of the side support members 30. Similarly, the handle 50 on the top member 26 may be grasped by the user when the top member is connected to the seat member 24. This advantageously allows a user to grasp the top member 26 having the seat member 26 connected thereto with one hand, and the collapsed main body member 22 of the lifting device 20 with the other hand.

The components of the lifting device 20 according to embodiments of the present invention may advantageously be made with aluminum material. An aluminum material may be advantageous as it has high strength properties and low weight. Those skilled in the art will appreciate, however, that the lifting device components 20 may be made of any number of materials while still composting the goals, features, and objectives according to the present invention.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed:

1. A lifting device comprising:

a main body member comprising a support connecting member;

a pair of side support members each hingedly connected to the support connecting member and each comprising a pair of legs and a plurality of spaced apart brace members connected to the pair of legs;

a top member that is detachably connectable to the pair of side support members, the top member comprising a top, a pair of opposing channels adapted to matingly engage a portion of the side support members, and a single hoist assembly comprising a single winch connected to and extending downwardly from the top;

an engagement strap connected to one end of a single line configured to position around a patient;

a handle connected to an upper section of the top member; and a seat member connected to the side support members and carried by a pair of opposing brace members;

wherein the pair of opposing channels of the top member are configured to orient the lifting device in different positions and widths; wherein the main body member is moveable between a collapsed position and an opened position;

wherein the collapsed position is defined as the pair of side support members being positioned adjacent to the support connecting member;

wherein the opened position is defined as the side support members being positioned substantially perpendicular to the support connecting member;

wherein when in the opened position, the top member may be detachably connected to the pair of side support members;

wherein the seat member comprises channels configured to orient the seat member in different positions and widths;

wherein the top comprises channels that are aligned with the channels of the seat member; and wherein the seat member channels and the top member channels are configured to orient the lifting device in different positions and widths.

2. The lifting device of claim 1 wherein the single hoist assembly is configured to be electrically operated.

3. The lifting device of claim 1 wherein the seat member is configured to be locked in place when connected to the brace members.

4. The lifting device of claim 1 wherein the seat member is configured to be removably attached to the brace members.

5. The lifting device of claim 1 wherein the top member and the seat member are removable from the main body member and attachable to each other; and wherein the top member and the seat member are configured to be transported together as a single unit with the hoist assembly positioned there between.

6. The lifting device of claim 5 wherein the top member and seat member are configured to be attachable as an integrated unit; and wherein the handle located on the top is configured to carry both the top member and the seat member when the top member and seat member are attached together as an integrated unit.

7. The lifting device of claim 1 wherein the body member of the lifting device includes foot members configured to reorient and stabilize the lifting device.

8. The lifting device of claim 1 wherein the body member of the lifting device includes foot members that are casters configured to mobilize the lifting device.

9. The lifting device of claim 1 wherein the side support members include hollow tubes configured to extend and retract legs therefrom.

10. A lifting device comprising:

a main body member comprising a support connecting member;

a pair of side support members each hingedly connected to the support connecting member and each comprising a pair of legs and a plurality of spaced apart brace members connected to the pair of legs; and a top member that is detachably connectable to the pair of side support members, the top member comprising a top, a pair of opposing channels adapted to matingly engage a portion of the side support members, and a single hoist assembly comprising a single winch connected to and extending downwardly from the top;

a single line connected to the winch that extends downward;

an engagement strap connected to one end of the single line configured to position around a patient;

a handle connected to the top of the top member;

wherein the pair of opposing channels of the top member are configured to orient the lifting device in different positions and widths;

wherein the main body member is moveable between a collapsed position and an opened position;

wherein the collapsed position is defined as the pair of side support members being positioned adjacent to the support connecting member;

wherein the opened position is defined as the side support members being positioned substantially perpendicular to the support connecting member;

wherein when in the opened position, the top member may be detachably connected to the pair of side support members;

wherein the winch is configured to release the single line and lower a patient secured by the engagement strap onto the seat member;

wherein the winch is configured to coil the single line and lift a patient secured by the engagement strap;

wherein the top comprises channels that are aligned with channels of the seat member;

wherein the seat member channels and the top member channels are configured to orient the lifting device in different positions and widths.

11. The lifting device of claim 10 further comprising a seat member connected to the side support members and carried by the pair of opposing brace members.

12. The lifting device of claim 10 wherein the main body may be collapsed into three portable components including two side support members and a carrying case comprising the top member, the seat member, and a handle.

13. The lifting device of claim 10 wherein the top member includes a series of channels configured to engage a pair of top connecting members that extend upwardly from the uppermost brace members on each of the side support members.

14. The lifting device of claim 10 wherein the single hoist assembly is configured to be electrically operated with a manual operation back-up.

15. A lifting device comprising:

a main body member comprising a support connecting member;

a pair of side support members each hingedly connected to the support connecting member and each comprising a pair of legs and a plurality of spaced apart brace members connected to the pair of legs; and a top member that is detachably connectable to the pair of side support members, the top member comprising a top, a pair of opposing channels adapted to matingly engage a portion of the side support members, and a single hoist assembly comprising a single winch connected to and extending downwardly from the top;

a single line connected to the winch that extends downward;

an engagement strap connected to one end of the single line configured to position around a patient;

a handle connected to the top of the top member;

a seat member removably connected to the side support members and carried by a pair of opposing brace members;

wherein the main body member is moveable between a collapsed position and an opened position;

wherein the top comprises channels that are aligned with channels of the seat member; wherein the seat member channels and the top member channels are configured to orient the lifting device in different positions and widths;

wherein the collapsed position is defined as the pair of side support members being positioned adjacent to the support connecting member;

wherein the opened position is defined as the side support members being positioned substantially perpendicular to the support connecting member;

wherein when in the opened position, the top member may be detachably connected to the pair of side support members;

wherein the main body is collapsible into three portable components including two side support members and a carrying case comprising the top member, the seat member, and a handle;

wherein the top member and the seat member are removable from the main body member and attachable to each other; and wherein the top member and the seat member are configured to be transported together as a single unit with the hoist assembly positioned there between.

16. The lifting device of claim 15 wherein the engagement strap is circular in shape and configured to extend around a patient underneath the patient's arms.

17. The lifting device of claim 15 wherein the winch is configured to electrically or manually coil the single line and lift a patient secured by the engagement strap; and wherein the winch is configured to release the single line and lower a patient secured by the engagement strap onto the seat member.

* * * * *